US008231477B2

(12) United States Patent
Jones et al.

(10) Patent No.: US 8,231,477 B2
(45) Date of Patent: Jul. 31, 2012

(54) GOLF AIDS

(75) Inventors: Derek Jones, Great Missenden (GB); Mark Trickett, Margueron (FR); David Carey Young, Lauzun (FR)

(73) Assignee: Aim-Mate SARL, Lot et Garrone (FR)

( * ) Notice: Subject to any disclaimer, the term of this patent is extended or adjusted under 35 U.S.C. 154(b) by 0 days.

(21) Appl. No.: 12/723,897

(22) Filed: Mar. 15, 2010

(65) Prior Publication Data

US 2010/0234120 A1 Sep. 16, 2010

(30) Foreign Application Priority Data

Mar. 13, 2009 (GB) ..... 0904377.9
Jun. 16, 2009 (GB) ..... 0910290.6
Aug. 26, 2009 (GB) ..... 0914886.7

(51) Int. Cl.
*A63B 69/36* (2006.01)

(52) U.S. Cl. ..... 473/218; 473/257

(58) Field of Classification Search ..... 473/218, 473/219, 257, 266, 270, 278, 386–403
See application file for complete search history.

(56) References Cited

U.S. PATENT DOCUMENTS

| | | | | |
|---|---|---|---|---|
| 2,461,601 | A * | 2/1949 | Hendricks | 473/398 |
| 3,920,248 | A | 11/1975 | Medders | 273/186 C |
| 4,235,440 | A * | 11/1980 | Hinckley | 473/257 |
| 5,171,017 | A | 12/1992 | Betancourt | 273/187 R |
| 5,275,570 | A | 1/1994 | Hicks | 434/252 |
| 5,356,133 | A * | 10/1994 | Bellagamba | 473/406 |
| 5,628,694 | A * | 5/1997 | O'Connor, Jr. | 473/157 |
| 5,910,053 | A * | 6/1999 | Scalise | 473/257 |
| D428,954 | S * | 8/2000 | Tate | D21/793 |
| 6,280,345 | B1 | 8/2001 | St. Martin | 473/278 |
| 6,592,376 | B1 | 7/2003 | Carpenter | 434/252 |
| 6,840,870 | B1 | 1/2005 | Froggatte | 473/265 |
| 6,945,875 | B2 * | 9/2005 | Gauer | 473/270 |
| 6,949,029 | B1 | 9/2005 | Strande | 473/257 |
| 7,131,910 | B2 * | 11/2006 | Townsend, II | 473/278 |
| D622,799 | S * | 8/2010 | Cameron | D21/794 |
| 2004/0016461 | A1 | 1/2004 | Qu et al. | 137/554 |
| 2005/0009645 | A1 * | 1/2005 | Isabell | 473/400 |

FOREIGN PATENT DOCUMENTS

| | | | |
|---|---|---|---|
| GB | 2066083 | A | 7/1981 |
| GB | 2 349 828 | A | 11/2000 |
| WO | WO 2005/077474 | A1 | 8/2005 |

OTHER PUBLICATIONS

EPO Search Report dated Jun. 29, 2010 from EP 101565349.7, 7 pgs.

* cited by examiner

*Primary Examiner* — Nini Legesse
(74) *Attorney, Agent, or Firm* — Woodard Emhardt Moriarty McNett & Henry LLP

(57) ABSTRACT

A golf aid (10) comprising an elongate alignment member (12) provided with at least one through-hole (16) for receiving a golf tee. The golf aid can provide a golfer who is looking down at the ball (30) to ensure the club head (32) is correctly addressing the ball with an indication of the line along which the ball is intended to travel.

1 Claim, 4 Drawing Sheets

366
358
316
310
352
350
316
312
357
360
359
356
357
316
314

366
364
316
362
316
310
356
312
361
316
314

310
314
359
361

GOLF AIDS

CROSS REFERENCES TO RELATED APPLICATIONS

This application claims priority to GB 0904377.9, filed Mar. 13, 2009, and to GB 0910290.6, filed Jun. 16, 2009, and also to GB 0914886.7, filed Aug. 26, 2009. All of these references are expressly incorporated by reference herein, in their entirety.

FIELD OF THE INVENTION

The invention relates to golf aids.

BACKGROUND OF THE INVENTION

When golfers are hitting the ball from the tee, it is important that the clubface is orientated perpendicular to the direction in which the ball is intended to go. Otherwise, the shot will send the ball off target. When addressing the ball, the player will typically look along the line the ball is intended to travel to the target area and then down at the ball. As soon as the player looks down, he/she has to rely on their memory of the direction of the line to the target area. Thus, there is always a compromise between being able to see the target area and the direction in which the ball needs to travel and seeing the ball and clubface.

BRIEF SUMMARY

The invention provides a golf aid comprising an elongate alignment member provided with at least one through-hole for receiving a golf tee.

The invention also includes a golf aid comprising an elongate alignment member made of an elastomer and provided with a plurality of apertures for receiving a golf ball support member, each aperture being disposed on a longitudinal axis of the alignment member and the alignment member have a leading end portion that tapers on each side of the longitudinal axis to a leading end thereof.

The invention also includes a golf aid comprising an alignment member fixable to the ground and cooperable with a golf ball support such that a golfer can align the alignment member with a target for a golf shot and align a clubface with the alignment member to assist in playing the shot with the clubface square to the target.

The invention also includes a golf aid comprising an elongate body provided with at least one through-hole extending between opposed major faces of the elongate body;

a first of the major faces being provided with a marking indicating a straight path extending along a lengthways extending center line of the elongate body;

a second of the major faces being provided with a marking indicating an arcuate path extending in a lengthways direction of the elongate body; and an end of the elongate body being provided with an arcuate recess to permit the end to be positioned against a golf ball.

The invention also provides a golf aid comprising an elongate golf shot alignment member provided with at least one through-hole for receiving a golf tee, the alignment member being configured to be flexible to permit folding or rolling of the alignment member in a lengthways direction thereof.

The invention also provides a golf aid comprising an elongate golf shot alignment member provided with at least one through-hole for receiving a golf tee, the alignment member being configured to be flexible such as to permit the or at least one through-hole to be forced over a cup of a golf tee that has a larger diameter than the through-hole.

The invention also provides a golf aid comprising an elongate golf shot alignment member provided with at least one through-hole for receiving a golf tee, the alignment member:

being configured to be flexible to permit folding or rolling thereof in a lengthways direction thereof;

having a first major surface provided with a marking indicating at least one arcuate path that extends in a lengthways direction said alignment member;

having a second major surface provided with a golf ball guiding channel extending in the lengthways direction thereof for guiding a golf ball moving along the second major surface and a plurality of spaced apart indicators provided in the channel for indicating a golf shot strength; and an arcuate recess provided in one end thereof to facilitate placing of the end adjacent a golf ball.

The invention also provides a golf aid comprising an elongate golf shot alignment member provided with at least one through-hole for receiving a golf tee, the alignment member having a first end, a second end, a first major surface extending between the first end and the second end and a longitudinal axis extending between the first and second end, the first major surface defining a golf ball guiding channel extending along the longitudinal axis to at least one of said first and second ends for guiding a golf ball moving along the first major surface.

BRIEF DESCRIPTION OF THE SEVERAL VIEW OF THE DRAWINGS

In order that the invention may be well understood, an embodiment thereof, which is given by way of example only, will now be described with reference to the drawings in which.

DETAILED DESCRIPTION

Figure 1:
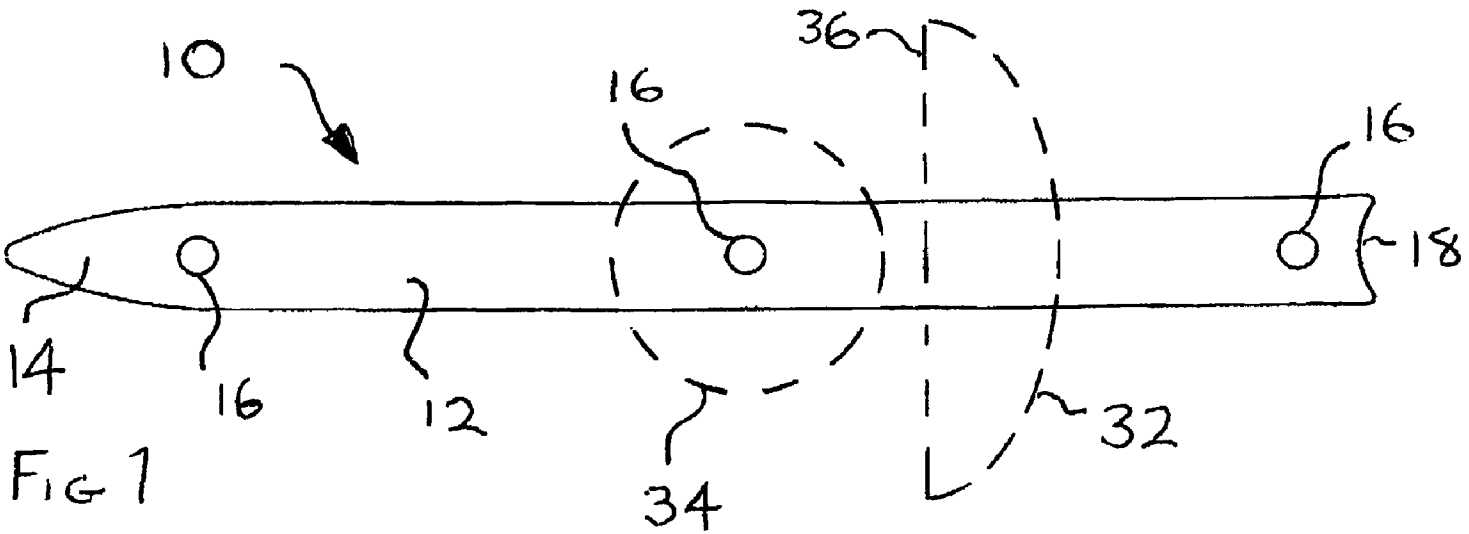
FIG. 1 is a schematic plan view of a golf aid also showing a golf ball and club head.

For the purposes of promoting an understanding of the disclosure, reference will now be made to the embodiments illustrated in the drawings and specific language will be used to describe the same. It will nevertheless be understood that no limitation of the scope of the disclosure is thereby intended, such alterations and further modifications in the illustrated device and its use, and such further applications of the principles of the disclosure as illustrated therein being contemplated as would normally occur to one skilled in the art to which the disclosure relates.

Figure 2:
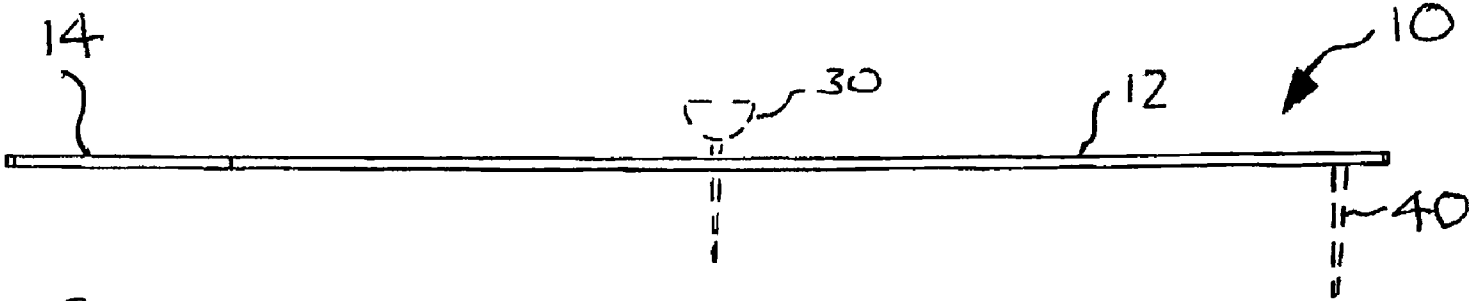
FIG. 2 is a schematic side view of the golf aid also showing a golf tee.

Referring to FIGS. 1 and 2, a golf aid 10 comprises a generally planar elongate alignment member 12. The alignment member 12 is provided with a tapering nose 14. At least one through-hole 16, in this case three, is provided in the alignment member 12. The through-holes 16 are sized to allow a golf tee to pass through the alignment member 12 to enter the ground below the golf aid and are disposed at spaced apart locations on the longitudinal axis of the alignment member. The end of the alignment member 12 opposite to the nose 14 is formed with an arcuate recess 18. The apex of the nose 14 and innermost point of the arcuate recess 18 are substantially aligned on the longitudinal axis of the alignment member 12.

The golf aid 10 may be made of any suitable material such as a plastics material, metal or wood. It is presently preferred that at least the top surface of the golf aid is made of an elastomer such as rubber, or similar such material, so that if the golfer makes a poor shot and hits the golf aid, the likelihood of damage to his/her golf club and/or of jarring is at least reduced. A more preferred embodiment of the golf aid 10 comprises a rubber casting.

In use, the golfer can squat down facing along the line along which he/she wishes to direct the ball and align the longitudinal axis of the golf aid 10 with that line. The golf aid 10 may be provided with markings or formations such as a rib to assist in the alignment process. He/she then pushes a tee 30 (FIG. 2) through a desired one of the through-holes 16 to pin the golf aid 10 in place. The golfer may then push a second tee (not shown) through another of the through-holes 16 and use that tee to support the ball, or simply use the tee 30 to shoot from.

It will be appreciated that if the golf aid 10 is suitably aligned with the line along which the ball is intended to travel, when the golfer looks down to make sure the club head 32 is correctly addressing the ball 34, he/she has the alignment member 12 to provide an indication of the desired direction of travel. Thus the golfer is assisted in making sure the face 36 of the club head 32 is square to the line along which the ball is intended to travel.

The golf aid 10 can also be used in assisting a golfer on the putting green. For this purpose, the golfer puts the recess 18 just behind the ball (ie so that the ball is between the hole and the golf aid) and aligns the alignment member 12 with the hole. Then, when the golfer comes to address the ball he/she can ensure that the face of the putter is square with the line to the hole by reference to its orientation to the alignment member 12. It will be appreciated that so as not to interfere with the path of the putter to the ball, the alignment member should be made as thin as possible while being sufficiently rigid and heavy to sit in a straight line on the ground.

Figure 3:
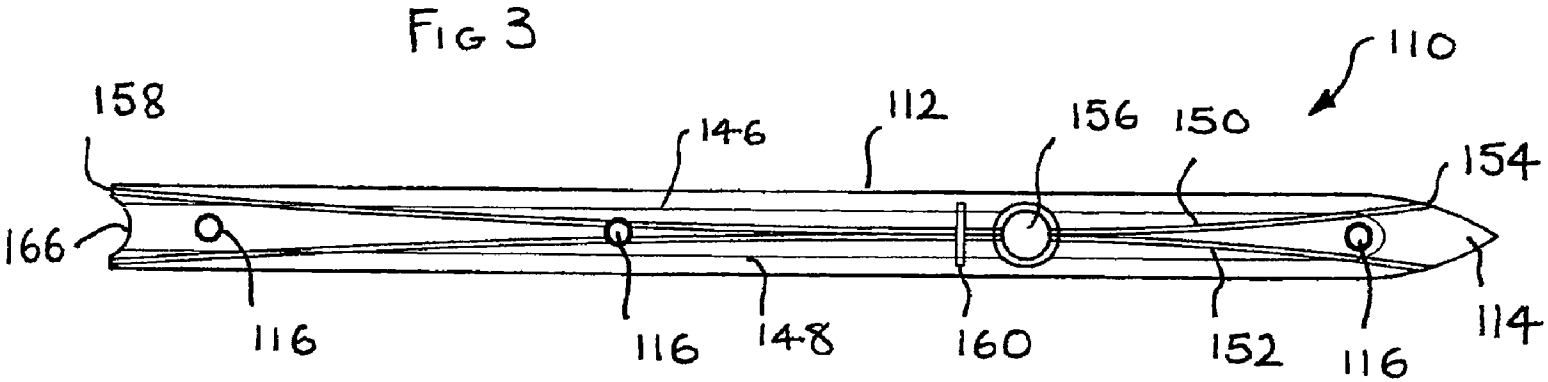
FIG. 3 is a plan view of another golf aid.
Figure 4:
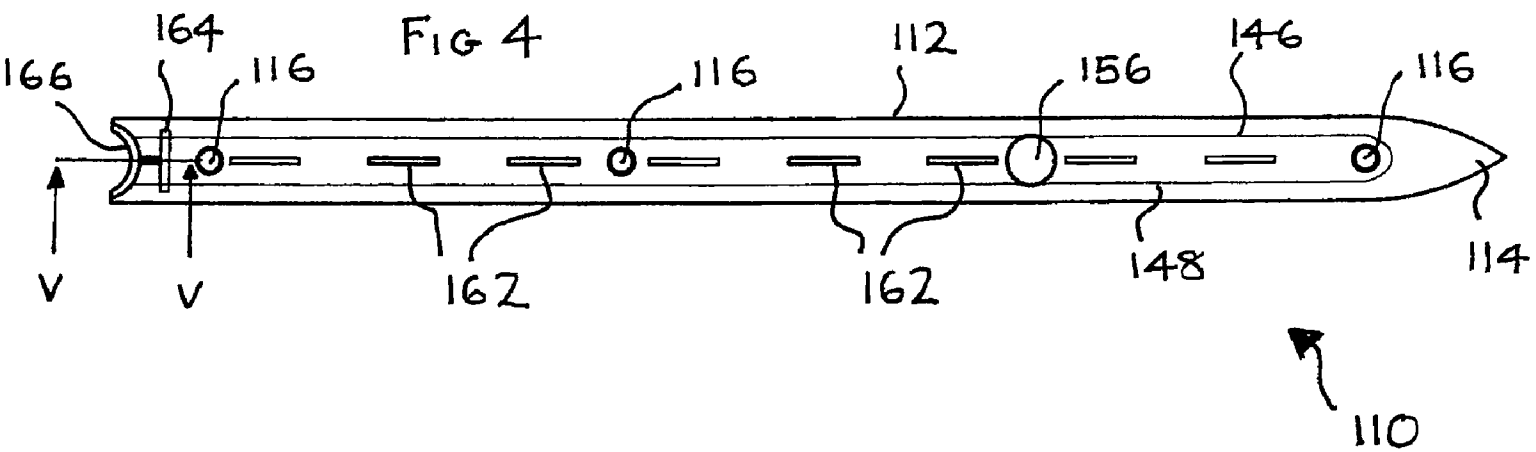
FIG. 4 is an opposite plan view of the golf aid of FIG. 3.
Figure 5:
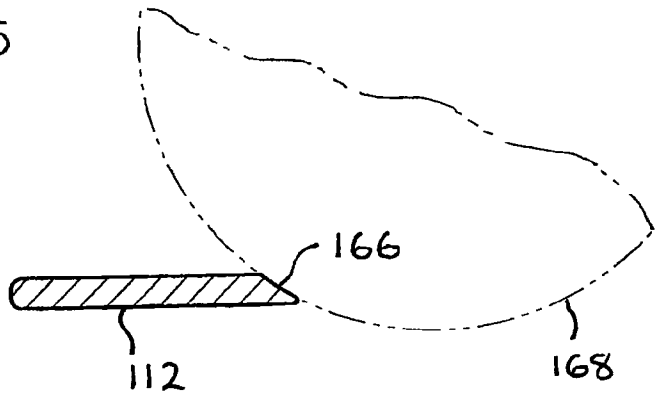
FIG. 5 is a section on line V-V in FIG. 4.

FIGS. 3 to 5 show another golf aid 110 that has many features that are the same as, or similar to, those of the golf aid 10. To avoid repetition of description, such features are indicated by the same reference numeral incremented by 100 and only features that differ from the golf aid 10 will be described in detail.

The golf aid 110 comprises an alignment member 112 that is substantially planar. The alignment member 112 has a flat central portion defined between lines 146, 148 such that the section between the two lines is generally rectangular. The alignment member 12 tapers outwardly from the lines 146, 148 to the respective lengthways extending edges of the alignment member. The taper may be flat or arcuate.

FIG. 3 shows a major surface, or face, of the golf aid 110 that is configured to assist a golfer when driving and FIG. 4 shows an opposite major surface, or face, of the golf aid that is configured to assist the golfer when putting.

Referring to FIG. 3, the face of the alignment member 112 that is configured to assist when driving is provided with arcuate markers 150, 152. The markers 150, 152 are disposed on opposite sides of a longitudinal centre line of the alignment member 112. The marker 150 is for use by a right-handed golfer and the marker 152 is for use by a left-handed golfer. The marker 150 has a first end 154 disposed at an end region of the alignment member 112 adjacent the nose 114. From the first end 154, the marker 150 curves axially inwardly of the alignment member to a through-hole 156. In the region of the through-hole 156, the marker 150 is disposed on, or adjacent, the longitudinal centre line of the alignment member 112. From this position, the marker curves axially outwardly of the alignment member 112 to its second end 158, which is disposed in the region of the end of the alignment member remote from the nose 114. In this embodiment, the marker 150 has its second end 158 at the very end of the alignment member 112. However, this is not essential. The marker is intended to indicate the correct arc of swing of a golf club in driving a ball located on a tee (not shown) that is located in the through-hole 156. The ends 154, 158 of the marker 150 will be disposed nearer or further from the two ends of the alignment member 112 depending on the length of the member and the position of the through-hole 156 relative to those ends. The marker 152 is a mirror image of the marker 150.

In this embodiment, the markers 150, 152 take the form of respective grooves in the alignment member 112 that are filled with a material different in colour to the material the alignment member is made from. The markers 150, 152 may be the same colour or different colours as desired.

In addition to the markers 150, 152, the alignment member 112 is provided with a marker 160 disposed adjacent the through-hole 156. The marker 160 is disposed perpendicular to the longitudinal axis of the alignment member 112.

Referring to FIG. 4, instead of the markers 150, 152, the face of the alignment member 112 configured to assist when putting has a marker 162 that extends along the longitudinal centre line of the alignment member 112. The marker 162 may be a continuous line in the same way as the markers 150, 152 or, as in the illustrated embodiment, a discontinuous line. The marker 162 may be defined by a groove, or grooves, filled with a different colour material in the same way as the markers 150, 152. This face of the alignment member is provided with a further marker 164 disposed adjacent the through-hole 116 that is disposed at the end of the alignment member that is remote from the nose 114. The marker 164 extends perpendicular to the longitudinal axis of the alignment member 112.

In the same way as the golf aid 10, the end of the alignment member 112 opposite the nose 114 is provided with an arcuate recess 166. As best seen in FIG. 5, the arcuate recess 166 is radiussed inwardly of the alignment member from the face provided with the markers 150, 152 towards the face provided with the marker 162. As illustrated by FIG. 5, the radiussing of the arcuate recess 166 facilitates presenting the recess to a golf ball 168 when using the golf aid to assist with putting.

The through-hole 156 is of a larger diameter that the through holes 116. Those skilled in the art will be familiar with the form of tee used on driving ranges. Essentially such tees are made of a rubber material, or a material having properties similar to rubber, and are configured to be secured in a hole provided in a mat from which driving takes place. The through-hole 156 is sized such that the golf aid 110 can be pressed down onto such a tee, passing over the head of the tee, to lie flat on the mat. For this purpose, the through-hole 156 needs to be sufficiently large that the head of the tee can pass through it by distorting without the golfer having to use undue force. At the same time, the through-hole 156 should not be so large that it is a very loose fit on the stem of the tee. It will be appreciated that an optimum diameter for the through-hole 156 can be determined empirically.

In use of the golf aid 110 when driving, the golfer secures the golf aid in place with the face provided with the markers 150, 152 facing upwards and the nose 114 pointing in the direction the ball is intended to travel. Provided the tee passes through the through-hole 156, the golfer can use the marker 160 to determine that the face of the club is correctly addressing the ball (see the club head 32 and ball 34 in FIG. 1). The marker 160 makes it easy for the golfer to determine that the face of the club will be substantially perpendicular to the direction the ball is intended to travel when the club strikes the ball. Using a marker 150, 152 (according to whether the he/she is left or right-handed) allows the golfer to ensure the arc of club through the swing is correct.

In use of the golf aid 110 when putting, the golf aid is laid down with the face provided with the marker 162 facing upwards and the arcuate recess 166 located against the ball such that the marker 162 is aligned with the direction the ball is intended to travel (or at least the initial direction of travel of the ball). The golfer is then able to use the marker 164 to ensure the head of the putter addresses the ball squarely and the marker 162 to ensure the putter travels in a straight line to the ball when making a shot. It will be appreciated that in embodiments such as that shown in FIG. 3 in which the marker 162 comprises a plurality of spaced apart elements, the golfer can use the marker elements to judge the strength of the shot. For example, if the ball 168 is received in the arcuate recess 166 and the putter head starts at different ones of the marker elements, the golfer can gain an appreciation of the shot strength obtained by starting the shot with the putter head at different distances from the ball.

It will be understood that while it is convenient for the golf aid 110 to be configured such that it can provide assistance during driving and putting, this is not essential. Instead, the golf aid can be provided with markers suitable for assisting in just one of driving and putting and, for example, the golf aid 110 could be supplied in pairs with one of the pair configured for assisting when driving and the other configured for assisting when putting.

The golf aid 110 is provided with markers in the form of grooves in the major surface(s) of the alignment member 112 that are filled with a different colour material. This is not essential. The grooves could, for example, be left empty. Alternatively, the marker(s) could be printed or otherwise drawn on the surface of the alignment member 112 or formed by ridges.

The through-hole 156 is optionally provided with a chamfer on the face of the golf aid 110 provided with the markers 150, 152. The chamfer is configured to receive a portion of a golf ball and allow the golfer to make use of the golf aid 110 when driving from the fairway. Additionally, or alternatively, the through-hole 156 may be chamfered on the face of the golf aid provided with the markers 162. Such a chamfer may be configured to provide a lead-in to assist in fitting the golf aid 110 over a tee at a driving range.

Figure 6:
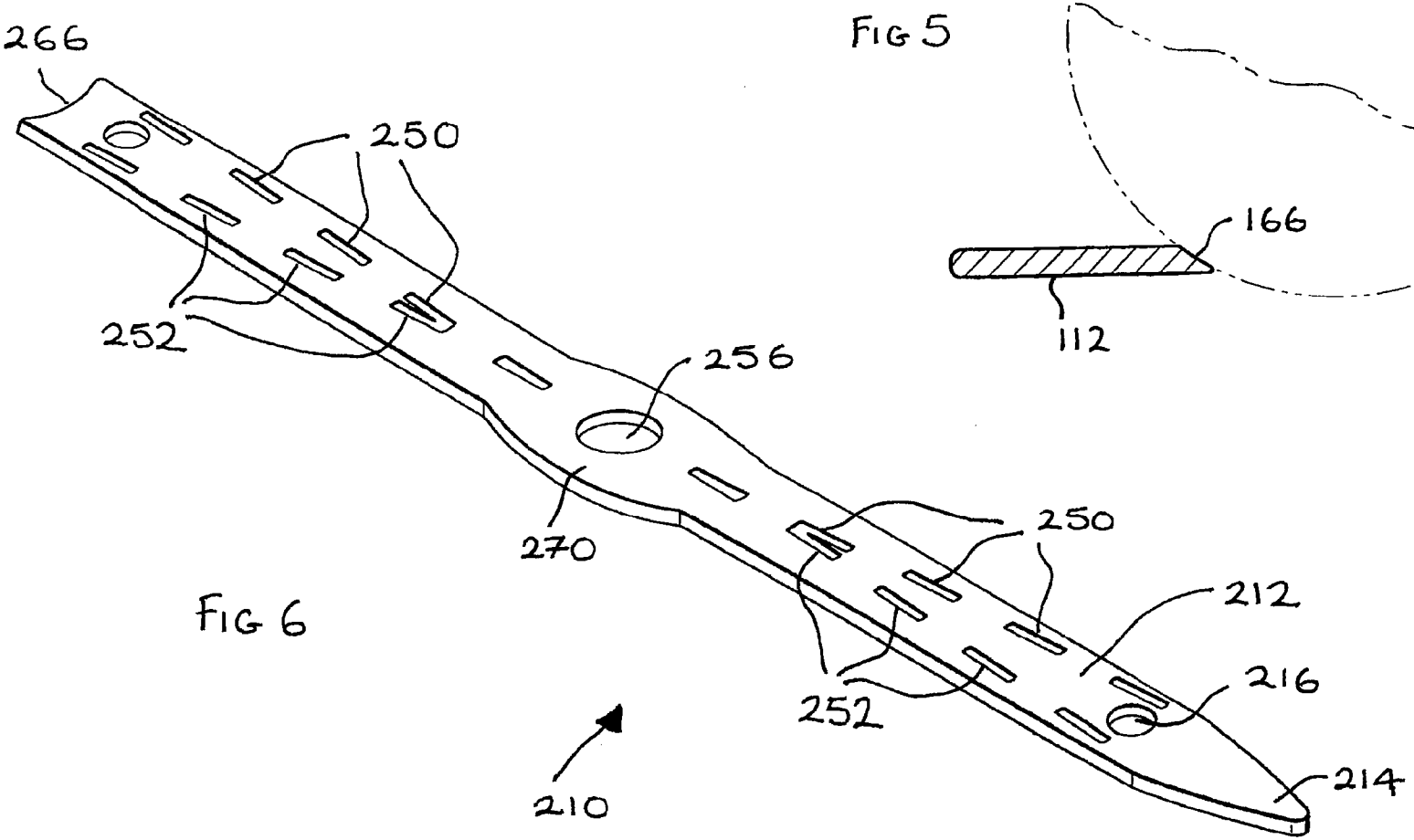
FIG. 6 is a perspective view of yet another golf aid.

FIG. 6 shows yet another golf aid 210. The golf aid 210 has a face configured to assist the golfer when driving in a way similar to the golf aid 110. To avoid repetition of description, features the same as or similar to those of the golf aid 110 are indicated by the same reference numeral incremented by 100.

In this embodiment, the markers 250, 252 are in the form of indents in the surface of the alignment member 212 and are filled with a material having a colour different to the colour of the material from which the alignment member is made. It will be appreciated that the difference between the markers 150, 152 and the markers 250, 252 is that the latter form a discontinuous line marking the correct arc for the swing of the club.

In the same way as the through-hole 156, the through-hole 256 is of a diameter selected to allow the golf aid 210 to be forced onto a tee of the type used at driving ranges. In this embodiment, the alignment member 212 is relatively narrower than the alignment member 112 and to allow the provision of a correctly sized through-hole 256, a bulge 270 is provided in the alignment member. The bulge 270 is sized such that the through-hole 256 is spaced sufficiently from the lengthways extending edges of the alignment member 212 to avoid breakage when the golf aid is forced over a tee. It will be understood that the sizing of the bulge 270 can be determined empirically. It will also be appreciated that this embodiment allows potential materials savings when compared with the embodiment shown in FIGS. 3 to 5 and that such savings could be significant when large numbers of the golf aid are being produced.

It will be understood that, although not shown, the golf aid 210 can be provided with a marker for assisting with putting analogous to the marker 162 shown in FIG. 4.

Figures 7, 8, 9:
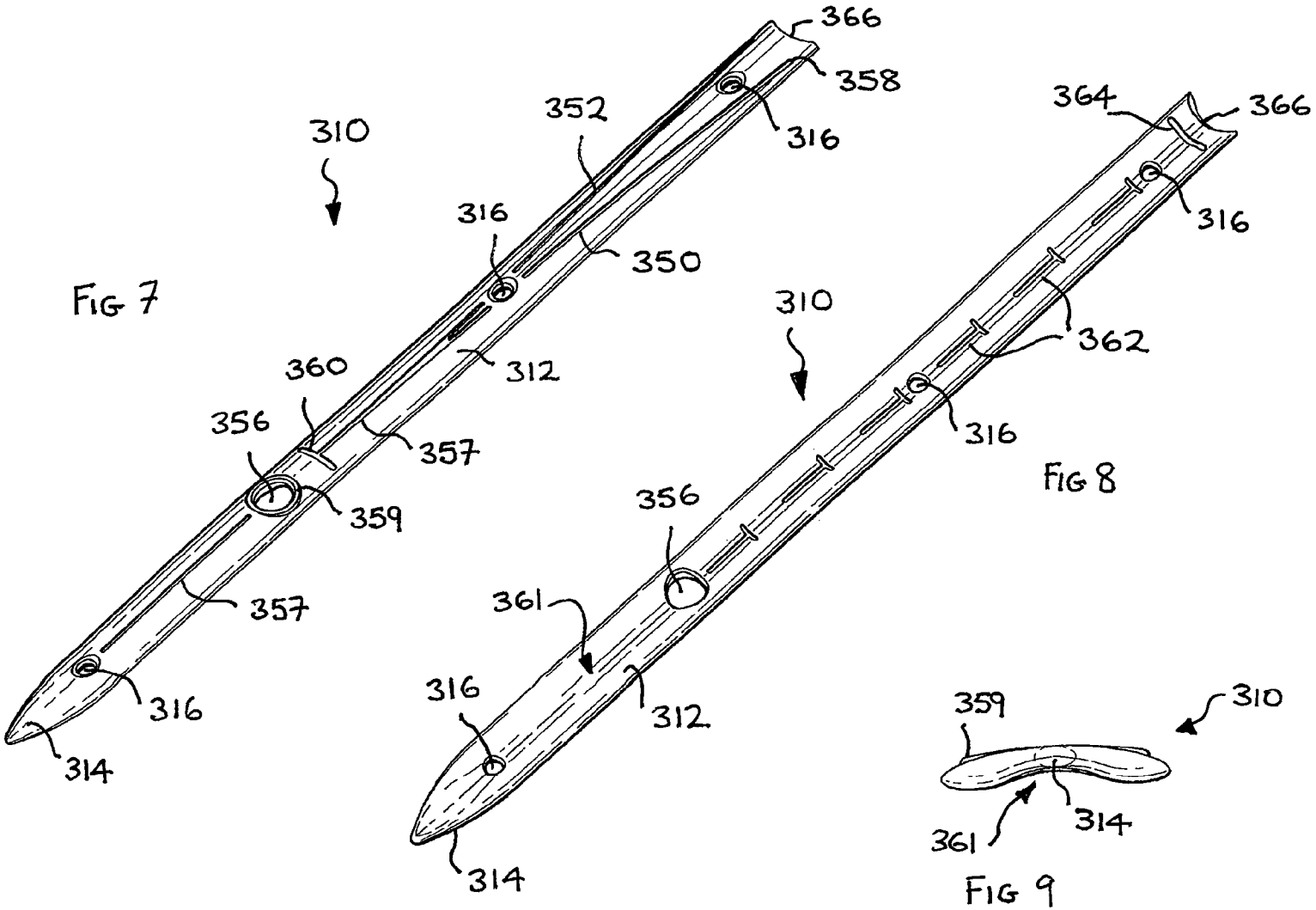
FIG. 7 is a perspective view of still another golf aid showing a first major surface of the golf aid.
FIG. 8 is a perspective view of the golf aid of FIG. 7 showing a second major surface of the golf aid.
FIG. 9 is an end view of the golf aid of FIGS. 7 and 8.

FIGS. 7 to 9 show modifications that can be made to the golf aid 110 to facilitate the use of the golf aid as an aid to putting. To avoid repetition of description features of the golf aid 310 shown in FIGS. 7 to 9 that are the same as or similar to those of the golf aid 110 will be given the same reference numeral incremented by 200.

The golf aid 310 comprises an elongate alignment member 312. A first end of the alignment member 312 defines a tapering nose 314 and the second, opposite, end defines a recess 366. The major surface, or face, of the golf aid 310 shown in FIG. 7 is configured to assist a golfer when driving and the major surface, or face, shown in FIG. 8 is configured to assist the golfer when putting. As shown in FIGS. 8 and 9, the face configured for assisting when driving is convex and the face configured for assisting when putting is concave such that the alignment member 312 has a generally arcuate cross-section through at least substantially all of its length.

Referring to FIG. 7, the markers 350, 352 for indicating the correct arc of swing of a golf club when driving a ball that is located in a tee (not shown) located in the through-hole 356 are modified as compared with the golf club 110. In this embodiment, the markers 350, 352 are separate at their ends 358 adjacent the end of the alignment member 312 provided with the recess 366 and curve axially inwardly as they extend towards the nose 314. The markers 350, 352 merge before reaching the through-hole 356 and continue towards the through-hole as a single line 357 that terminates at the marker 360. A continuation of the single line 357 is provided between the through-hole 356 and the through-hole 316 that is closest to the nose 314. The position and curvature of the markers 350, 352 is selected such as to indicate the correct arc of swing for striking a ball located on a tee located in the through-hole 356 and the point at which they merge represents the position at which the golfer's body should begin to twist to ensure the club head travels in a straight line to strike the ball in the required direction. It will be appreciated that the positioning and curvature of the markers 350, 352 and the point at which they merge is determined according to the length of the alignment member 312 and the location of the through-hole 356 along that length.

In addition to the modification of the arc of swing markers 350, 352, a rim 359 is provided around the through-hole 356 to strengthen the alignment member 312 adjacent the through-hole to assist in preventing damage to the golf aid 310 when forcing the golf aid 310 over a tee on a driving range mat. The rim 359 may also be configured to provide a seat for a golf ball to assist in locating a golf ball when using the golf aid 310 to assist in driving from the fairway.

Referring to FIGS. 8 and 9, the face of the golf aid 310 that is configured to aid when putting is concave so as to define an axially extending channel 361. The channel 361 extends from the nose 314 to the recess 366. The centre line and deepest point of the channel 361 is aligned with the longitudinal axis of the alignment member 312.

In use, when a golfer wishes to use the golf aid 310 to assist with putting, he/she may use it in the same way as the golf aid 110, as illustrated by FIG. 5. Alternatively, the ball may be placed in the channel 361. In that case, the golfer aligns the channel with the hole, or the direction in which the putt is to be directed to account for the lie of the green and then the ball is placed at a desired position in the channel. Typically, although not essentially, the golfer will place the golf ball in the through-hole 356 and putt towards the nose 314 of the alignment member 312. When the golfer makes his/her putt, the ball is initially guided by the channel 361 before landing on the putting green. It is believed this in combination with the shot strength indication provided by the spaced apart components of the marker 362 will assist golfers in practicing the art of judging the target path and relying on the pace of the ball to get the ball to the hole.

It will be appreciated that it is not essential that the golf ball guide channel extends along the entire length of the alignment member. Instead, the channel may extend from a position intermediate the ends to one of the ends. It will also be appreciated that it is not essential to make one face of the golf aid concave to define the guide channel. For example, a guide channel may be defined by providing opposed spaced apart formations, or ribs, on the face of the golf aid that is configured to assist putting. In that case, the face configured to assist when putting may be flat rather than concave.

Each of the illustrated embodiments may be made of an elastomer, such as rubber, or a similar material. At present, it is preferred that the golf aid is relatively thin, for example in the region of 3 to 5 mm, and has a length of around 40 to 80 mm. It has been found that this configuration provides a golf aid that has sufficient flexibility as to allow the golfer to readily fold or roll it and keep it in a pocket of his/her clothing when not in use. It will be understood that the dimensions given are not to be taken as limiting and merely illustrative of embodiments that provide flexibility and convenience of storage for the golfer.

It will be appreciated that a tee may be formed as an integral part of the golf aid.

It will be appreciated that as an alternative to using one or more golf tees to pin the alignment member to the ground, the golf aid may be provided with suitable pins that can be supplied as separate parts or form a part of the alignment member. An example of a suitable location for an integral pin 40 is shown in dashed lines in FIG. 2. Having an integral pin as illustrated may assist the golfer in at least partially fixing the golf aid prior to aligning the alignment member. In the case of a rubber golf aid, the integral pin can be made of a harder plastics material or metal and the golf aid formed by insert moulding.

It will be appreciated that in order to form new embodiments, features of the different embodiments illustrated in the drawings can be readily transposed between the embodiments as desired.

It will be appreciated that embodiments of the golf aid can assist a golfer in working on two different aspects of the game, driving and putting, and yet still provide the convenience of being rolled or folded to allow storage in a pocket of an item of clothing.

It will be appreciated that embodiments of the golf aid may comprise an elongate alignment member provided with at least one through-hole for receiving a golf tee.

It will be appreciated that embodiments of the golf aid may comprise an elongate alignment member made of an elastomer and provided with a plurality of apertures for receiving a golf ball support member, each said aperture being disposed on a longitudinal axis of said alignment member and said alignment member have a leading end portion that tapers on each side of said longitudinal axis to a leading end thereof.

It will be appreciated that embodiments of the golf aid golf aid may comprise an alignment member fixable to the ground and cooperable with a golf ball support such that a golfer can align said alignment member with a target for a golf shot and align a clubface with said alignment member to assist in playing said shot with said clubface square to said target.

It will be appreciated that embodiments of the golf aid may comprise an elongate body provided with at least one through-hole extending between opposed major faces of said elongate body;

a first of said major faces being provided with a marking indicating a straight path extending along a lengthways extending centre line of said elongate body;

a second of said major faces being provided with a marking indicating an arcuate path extending in a lengthways direction of said elongate body; and an end of said elongate body being provided with an arcuate recess to permit said end to be positioned against a golf ball.

While the preferred embodiment of the invention has been illustrated and described in the drawings and foregoing description, the same is to be considered as illustrative and not restrictive in character, it being understood that all changes and modifications that come within the spirit of the invention are desired to be protected.

The invention claimed is:

1. A golf aid comprising an elongated golf shot alignment member provided with at least one through-hole for receiving a golf tee, said alignment member:

a) having a length direction extending between a first end and an opposite second end;

b) being constructed and arranged to be flexible to permit folding or rolling thereof in said length direction;

c) having a first major surface provided with a marking indicating at least one arcuate path that extends in said length direction;

d) having a second major surface provided with a golf ball guiding channel extending in said length direction for guiding a golf ball moving along said second major surface and a plurality of space apart indicators provided in said channel for indicating a golf shot strength; and e) an arcuate recess provided in one of said first and second ends to facilitate placing of said one end adjacent a golf ball.

* * * * *